US005445790A

United States Patent [19]

Hu et al.

[11] Patent Number: 5,445,790

[45] Date of Patent: Aug. 29, 1995

[54] PROCESS FOR DENSIFYING POWDER METALLURGICAL PRODUCT

[75] Inventors: Chen-Ti Hu, Taipei; Wen-Chih Chiou, Miaoli, both of Taiwan

[73] Assignee: National Science Council, Taipei, Taiwan

[21] Appl. No.: 238,716

[22] Filed: May 5, 1994

[51] Int. Cl.[6] ..... B32F 3/12

[52] U.S. Cl. ..... 419/44; 419/32; 419/31; 419/43; 419/38; 419/54

[58] Field of Search ..... 419/38, 31, 32, 43, 419/44, 54

[56] References Cited

U.S. PATENT DOCUMENTS 4,762,558 8/1988 German et al. ..... 75/246

OTHER PUBLICATIONS

"Reactive Sintering Nickel-Aluminide to Near Full Density"; A. Bose; Powder Metallurgy International, vol. 20, No. 3, 1988, 5 pages.

"Elemental Powder Approaches to Ni-A1-Matrix Composites"; A. Bose et al; Journal of Metals, Sep. 1988; pp. 14–17.

Dixon, et al., "Powder Metallurgy for Engineers", Machinery Publishing Co., 1971, pp. 30–51.

*Primary Examiner*—Donald P. Walsh
*Assistant Examiner*—Daniel Jenkins
*Attorney, Agent, or Firm*—Christie, Parker & Hale

[57] ABSTRACT

A process for densifying a powder metallurgical product comprising steps of preparing a powdery starting material, pre-sintering the powdery starting material at a relatively low temperature, executing a pore-eliminating process for eliminating pores resulting from the preceding step on the powdery starting material, and sintering the powdery starting material at a relatively high temperature. It is beneficial to produce a product having a large dimension, a desired shape, and excellent mechanical properties, and being appropriate for or capable of suffering any post-treatment.

42 Claims, 12 Drawing Sheets

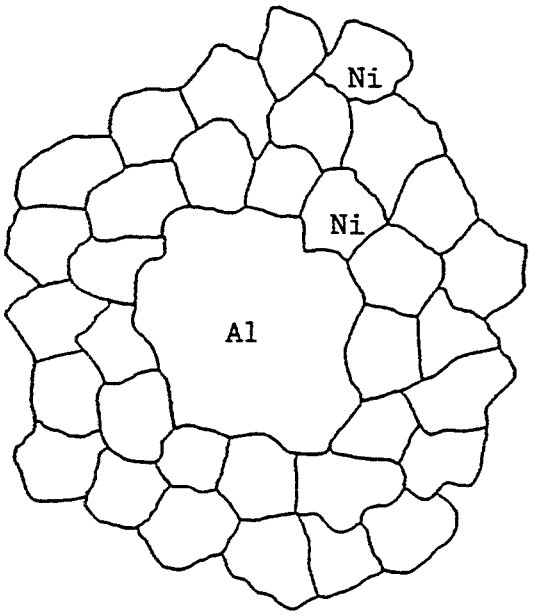
Fig. 2-(a)
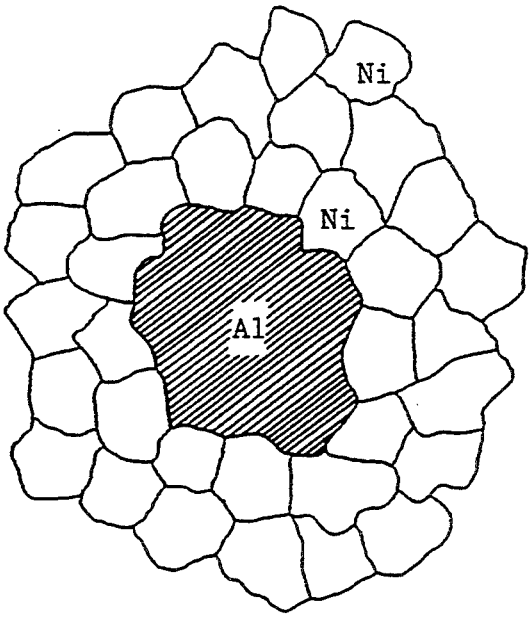
Fig. 2-(b)
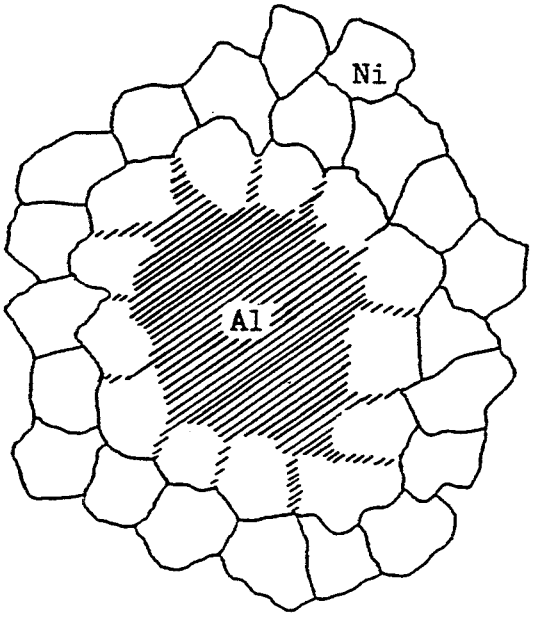
Fig. 2-(c)
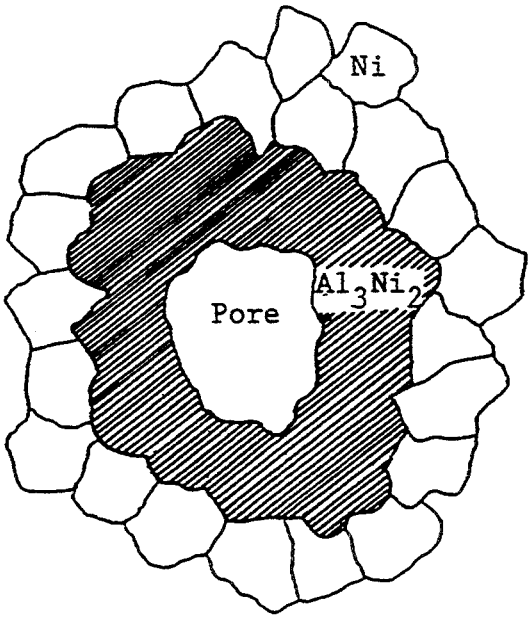
Fig. 2-(d)

PROCESS FOR DENSIFYING POWDER METALLURGICAL PRODUCT

FIELD OF THE INVENTION

The present invention relates to a process for manufacturing a product, and more particularly to a process for densifying a powder metallurgical product.

BACKGROUND OF THE INVENTION

Ni—Al intermetallic compounds, such as $Ni_3Al$ or the like, have been attracting people's attentions for advanced applications recently due to their many extraordinary properties, such as a high melting point without the transformation of the solid solution commonly observed in nickel-base superalloys, and increasing yield strength with temperature due to thermally activated cross-slip pinning process. In addition, the intrinsic brittleness of polycrystalline $Ni_3Al$ compound at ambient temperatures has been eliminated by microalloying with boron (B, 0.1 percent by weight). These make it extremely attractive for aviation and structural applications at elevated temperatures. However, the superalloy used in turbine industries has not been replaced by $Ni_3Al$. The major problem in manufacturing with melting and casting technique is the strong tendency of Al to oxidize at elevated temperatures, which causes metal-crucible and metal-ceramic interactions during vacuum melting and vacuum investment casting, respectively, as during the regular processing of turbine blades. The increasing yield strength with temperature characteristics also causes the problem of selecting the suitable die material for the post-ingot wrought deformation as a wrought material after ingots have been formed.

Powder metallurgical methods have been alternatively studied by melting raw metals into an alloy and atomizing the alloy into intermetallic powders. It is therefore called pre-alloying powdering method. The thus obtained intermetallic powders adopted as a starting material for powder metallurgical process have the following shortages of suffering from:

1. a required high energy consumption due to an additional process for melting;
2. difficulties on molding to powder compacts due to the hardness of the obtained pre-alloying powders;
3. a high wearing rate caused by them to the mold;
4. a tendency of getting oxidized; and
5. a required high sintering temperature.

There is another method called "mechanical alloying" to finely grind and uniformly mix pure elemental powders by using a high power ball mill. However, the hardening of the ground powder particles makes them not easy to be molded and shaped. In addition, the contamination resulting from the oxidization of the powders during grinding and the degradation of the surface of the balls in the ball mill or of the inner wall of the ball mill are unavoidable. Instead, some of those skilled in the art also set forth the related study by taking pure elemental powders, such as pure Ni and pure Al powders, as a starting material. Three of the representative prior arts, Powder Metal. Int., Vol. 20, No. 3, 25, 1988, J. of Metals, 14, Sep., 1988, and U.S. Pat. No. 4,762,558, all were disclosed by R. M. German et al., report a process, called reactive sintering, executed under a low sintering temperature by taking advantage of the evolved heat and a temporarily formed transient liquid phase during the reaction of the powders. This method is still far from serving as a practical usage, and lacks reports about the mechanical properties of the sintered products to be foundedly supported. Furthermore, a large amount of pores, about 20% of pore density, are formed when the sintering temperature is directly raised to about or above 800° C. Besides, a compound NiAl is possibly formed accordingly to provide a product, being hard and having a low ductility, difficult for further processing. Even at an elevated temperature, the product is still hard. Owing to the low ductility and the high pore density of the sintered product, the product is too hard to process and too brittle to free from cracking so that the cracks of the product have already been resulted before the pore having been able to be healed during processing. It is a common problem people have to face upon manufacturing an intermetallic compound product.

In summary, the shortages of the prior processes include:

1. The product produced thereby has defects in structure;
2. The product produced thereby has poor mechanical properties;
3. One cannot control the temperature distribution in the product during the sintering process so that it is unable to inhibit the formation of the unwanted compounds;
4. The product produced thereby is unsuitable for further hot or cold processes;
5. It is unable to effectively eliminate the pores in the formed product;
6. The product produced thereby is difficult to be molded or shaped; and This invention is affordable to improve the product density to prevent the product from cracking and capable of solving the aforementioned problems.

SUMMARY OF THE INVENTION

An object of the present invention is to offer a process for densifying the obtained product.

Another object of the present invention is to offer a process to obtain a product having excellent mechanical properties.

Another object of the present invention is to offer a process to obtain a desired product by effectively controlling the temperature distribution therein.

Another object of the present invention is to offer a process to obtain a product suitable for further hot or cold processes.

Another object of the present invention is to offer a process to effectively eliminate the pores in the obtained product.

Another object of the present invention is to offer a process capable of easily molding or shaping the product.

In accordance with the present invention, a process for densifying a powder metallurgical product comprising: preparing a powdery starting material, compressing and mixing the powdery starting material, introducing a heat absorbent to be in contact with the powdery starting material, pre-sintering the powdery starting material at a relatively low temperature, executing a pore-eliminating process for eliminating the preceding formed pores on the pre-sintered powdery starting material, sintering the pre-sintered powdery starting material at a relatively high temperature, and proceeding another pore-eliminating process for the sintered powdery starting material and an annealing process for further annealing the sintered powdery starting material.

In accordance with another aspect of the present invention, the powdery starting material comprises Ni and Al, Fe and Al, Ti and Al, or Ni and Ti elemental powders.

In accordance with another aspect of the present invention, the pre-sintered powdery starting material has a relative small amount of a high-Ni content compound and a relative large amount of a low-Ni content compound wherein the high-Ni content compound is $Ni_3Al$ and the low-Ni content compound is $Ni_2Al_3$ or $NiAl_3$ wherein $Ni_2Al_3$ is preferably.

In accordance with another aspect of the present invention, the sintering process results in a reaction of the low-Ni content compound with the Ni powders.

In accordance with another aspect of the present invention, the pore-eliminating process is capable of condensing the pre-sintered powdery starting material to have a reduced cross-section and is rolling, calendering, drawing, extruding, forging, or pressing, and the pore-eliminating process is either a cord or a hot deformation process.

In accordance with another aspect of the present invention, a temperature of the pre-sintered powdery starting material is controlled under 800° C. and preferably under 700° C.

In accordance with another aspect of the present invention, the heat absorbent is a material being inert to the powdery starting material and is a ferrous alloy, a stainless steel, Cu, Cu-based alloys, Ni, Ni-based alloys, or a mixture thereof.

In accordance with another aspect of the present invention, the heat absorbent is in contact with the powdery starting material in a way of encompassing an outer surface of the powdery starting material or being embedded to an interior of the powdery starting material, wherein the interior of the powdery starting material is a tubular hollow.

In accordance with another aspect of the present invention, the heat absorbent is formed as a tube, a sealing bag, a washer, a liner, a mold, or a combination thereof.

In accordance with another aspect of the present invention, the heat absorbent further contains a cooling system therewith comprising a pipe and a coolant flowing therethrough.

In accordance with another aspect of the present invention, the relatively low temperature is ranged from 500° C. to 800° C. and preferably ranged within 650°±50° C.

In accordance with another aspect of the present invention, the relatively high temperature is ranged from 1000° C. to 1465° C. and preferably ranged within 1133° C. to 1250° C.

In accordance with another aspect of the present invention, the powdery starting material is further introduced therein with additional elementary powders such as pure B powders or Ni—B alloy powders.

In accordance with another aspect of the present invention, the additional elementary powders are, via a process of mixing or electroless plating processes, introduced into the powdery starting material.

In accordance with another aspect of the present invention, the pre-sintering process gives an intermediate product of $Ni_2Al_3$+B.

In accordance with another aspect of the present invention, a residual unreacted Ni phase is formed after said pre-sintering process.

In accordance with another aspect of the present invention, the sintering process gives a final product having a dual phase.

In accordance with another aspect of the present invention, the sintering process gives a final product selected from a group consisting of $Ni_3Al$+0.1% B and a two-phase mixture of $Ni_3Al$+0.1% B and NiAl+0.1% B.

The present invention may be best understood through the following description with reference to the accompanying drawings, in which:

BRIEF DESCRIPTION OF THE DRAWING

FIGS. 2*a*–2*d* are four schematic representations of a hypothetical reaction mechanism during the sintering process for a product according to this invention;

DETAILED DESCRIPTION OF THE PREFERRED EMBODIMENT

Figure 3:
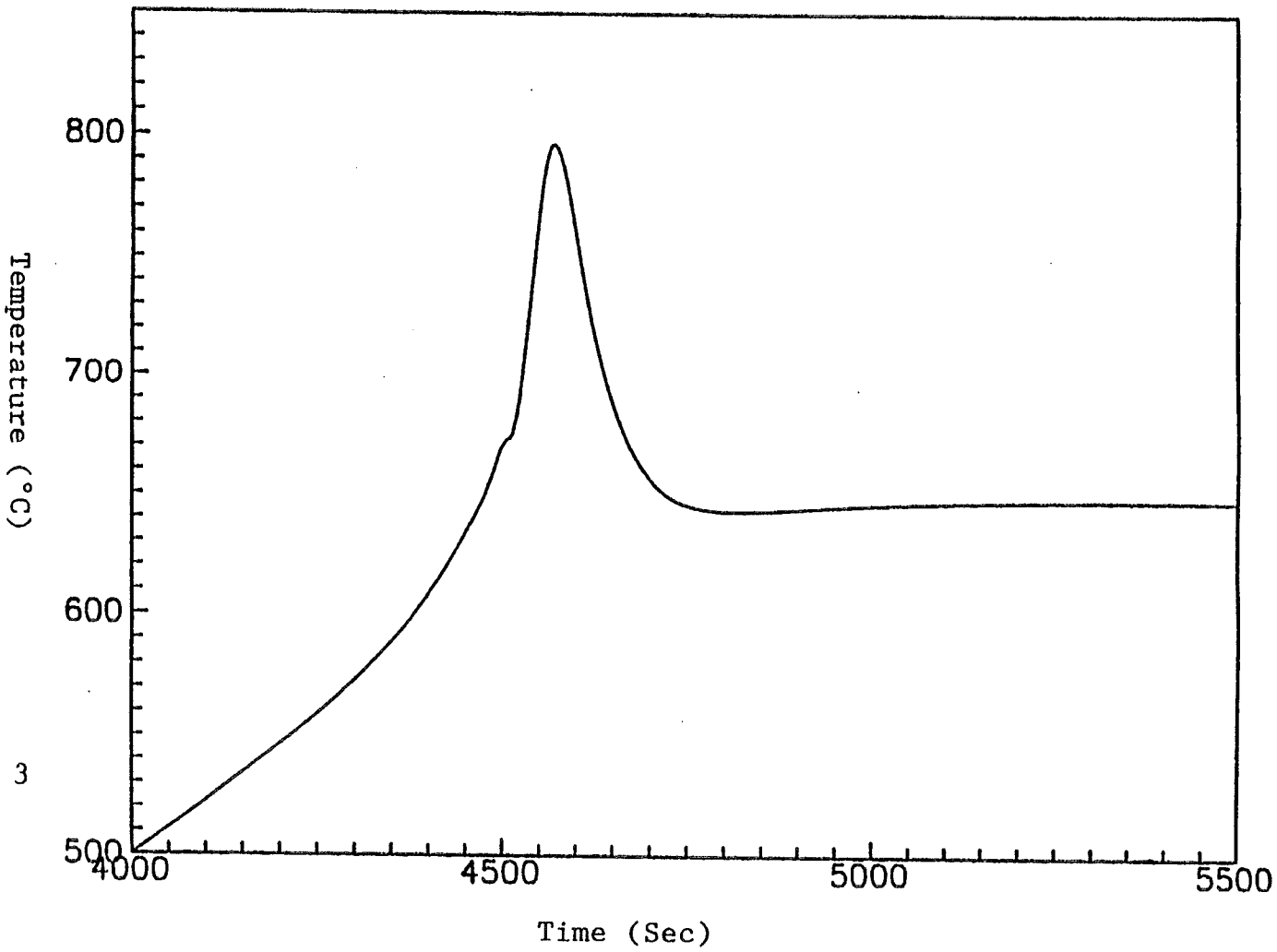
FIG. 3 is a temperature versus time curve of a first compact powder without any heat absorbent according to this invention.
Figure 4:
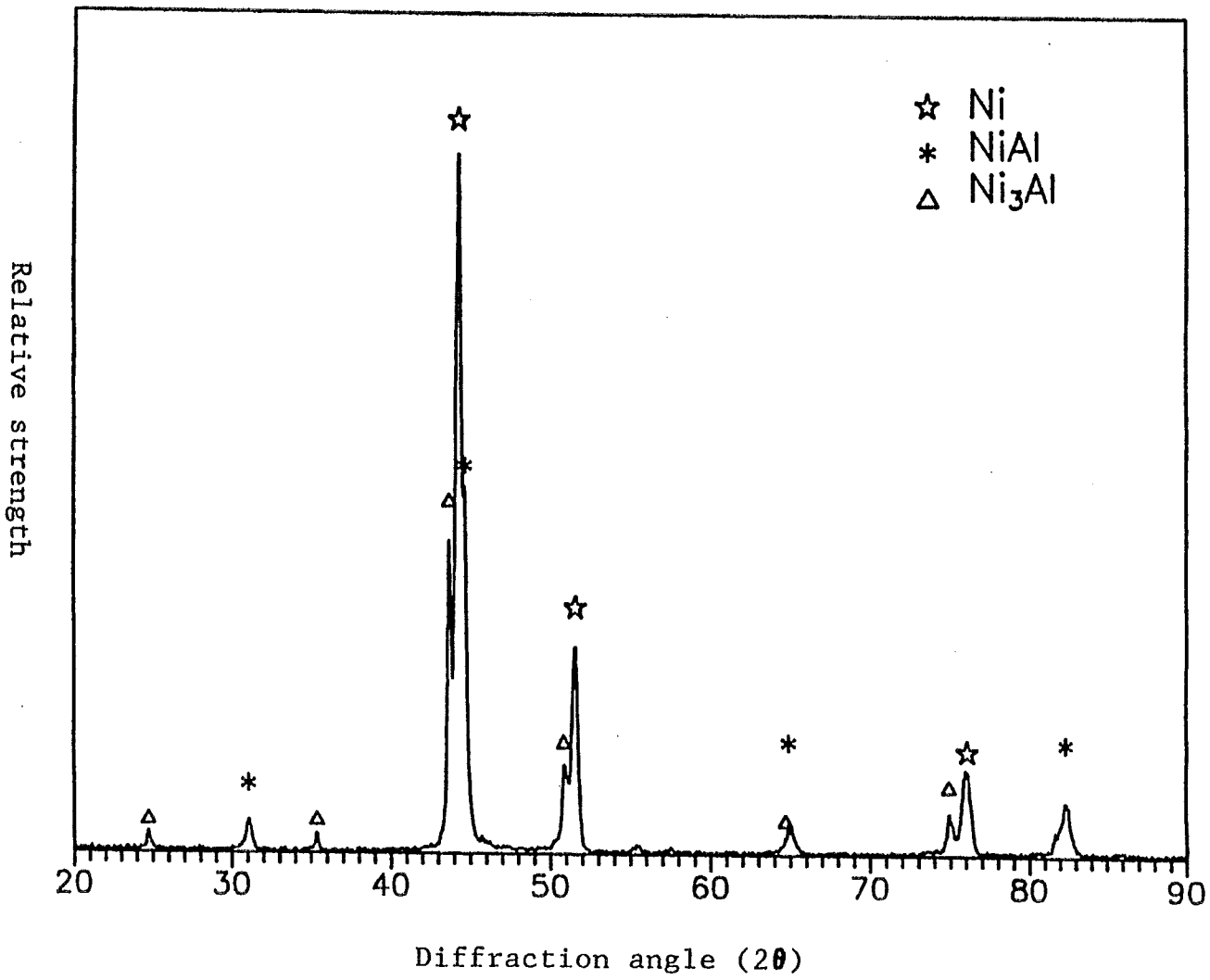
FIG. 4 is an X-ray diffraction analysis of a first pre-sintered specimen without any heat absorbent according to this invention.
Figure 6:
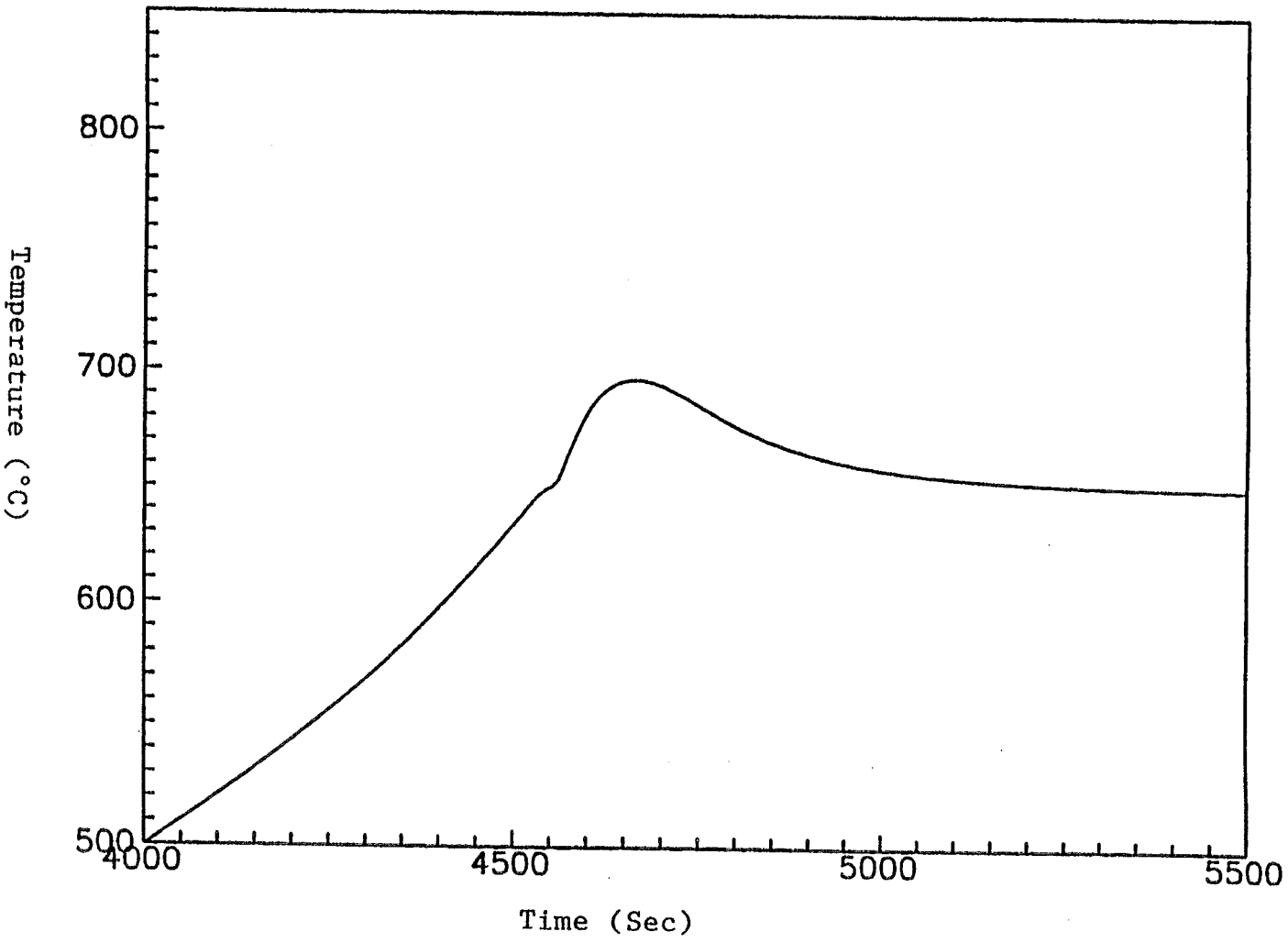
FIG. 6 is a temperature versus time curve of a second compact powder with a heat absorbent according to this invention.
Figure 7:
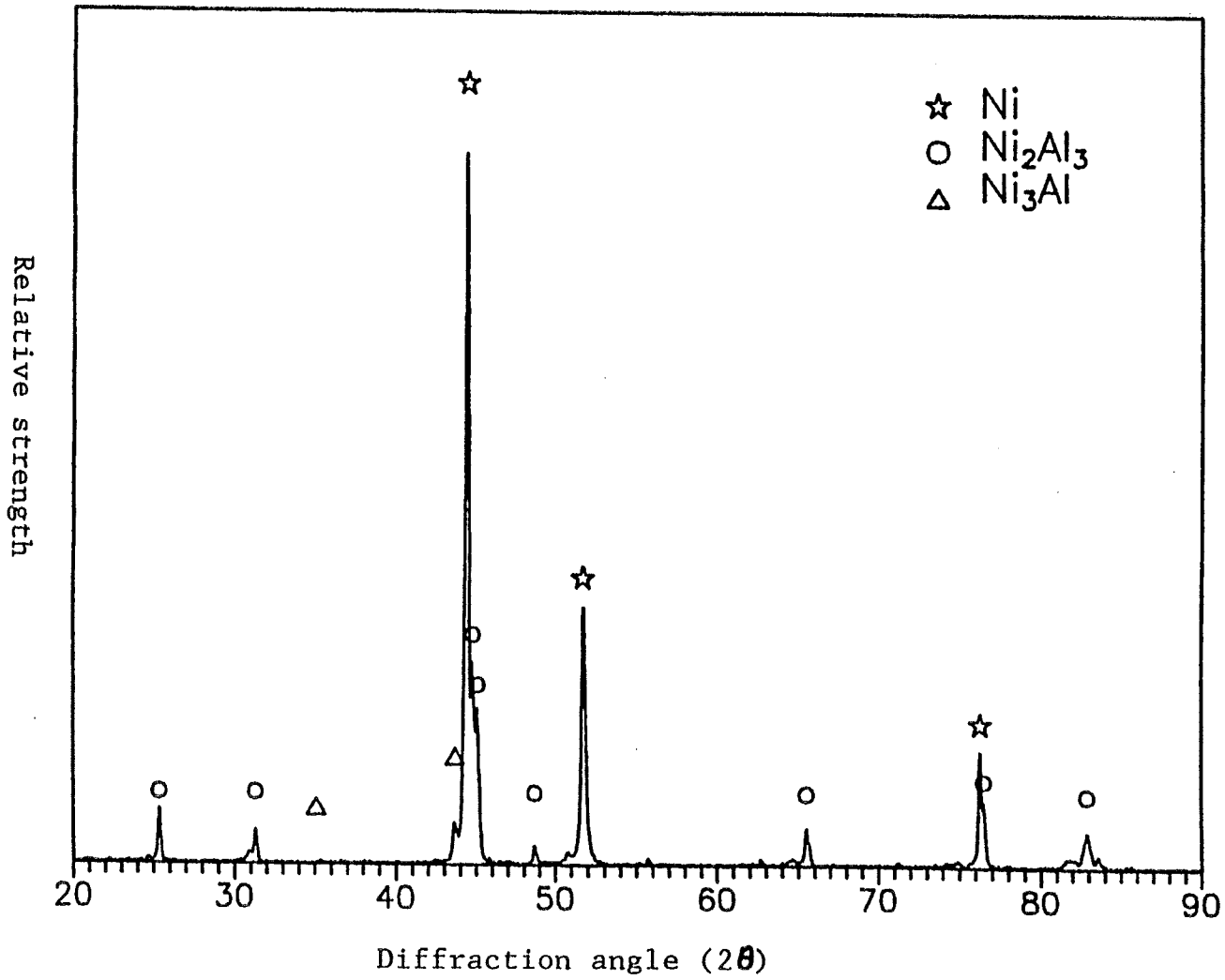
FIG. 7 is an X-ray diffraction analysis of a second pre-sintered specimen with a heat absorbent according to this invention.

This invention discloses a method comprising multi-stage sintering processes. In a primary experiment by the Inventors, a temperature of about 650° C. (slightly below the melting point of pure Al) was controlled for the preliminary sintering process. The formed pores within the preliminary phases of the compact powders were collapsed with plastic deformation after the preliminary sintering process. Then a high temperature normal sintering process, a single or multiple cycles of a pore-eliminating process and an annealing process were applied to the compact powders. We found that the obtained first semi-product (sintered first compact powders without any heat absorbent), if being subjected to a cold rolling, cracked when suffering only a minor deformation of about 7.5%. After being identified via an X-ray diffraction analysis of the first semi-product, the cause of cracking was found to be attributed to the brittleness thereof resulting from the formation of a NiAl phase, as shown in FIG. 4 and in FIGS. 1*a*–1*c*. Therefore, there would be problematic to proceed the original experiment. After further studies, the Inventors found that when the compact powders without any heat absorbent were sintered at 650° C., the evolved heat gave rise to an elevation of a local temperature of the sintered compact powders to a temperature above 800° C., as shown in FIG. 3. The phenomenon of locally heating the sintered compact powders would be effectively overcome by introducing a heat absorbent inert to the compact powders. The heat absorbent, such as a stainless steel shell, a tube, or a mold, when encompassing the compact powder, absorbed or dispersed the heat evolved from the reaction to lower the temperature of the compact powders to about 700° C., as shown in FIG. 6. Through an X-ray diffraction analysis, we found in the semi-product with a heat absorbent that there existed a $Ni_2Al_3$ phase of a large amount and a $Ni_3Al$ phase of a small amount, as shown in FIG. 7. When the semi-product was subject to a cold work, it did not crack or break even under a deformation of above 30%. Therefore, the porosity of the compact was effectively collapsed and reduced. The subsequent normal sintering process was executed at an elevated temperature of about 1200° C. to transform phases of the semi-product into a $Ni_3Al$ phase and to form a liquid phases from $Ni_2Al_3$ which fills into the cracks and crazes formed in the compact to eliminate them. During the normal sintering process, a less amount and size of pores were formed and were easily eliminated through a post-treatment such as a cold work, annealing, or homogenization process. Accordingly, the purpose for densifying a Ni—Al intermetallic compound having a high strength through a powder metallurgical process was satisfied.

In general, this invention is achieved via a way of controlling the temperature of the compact powders during the preliminary sintering process to prevent the compact from dramatically elevation of its temperature and to inhibit the formation of a high-Ni content compound such as NiAl which is notoriously responsible for causing the brittleness to the compact powders so that they are unsuitable for further processing to mechanically eliminate or heal the pores therein. A metal or the other material inert to the starting material is utilized as an heat absorbent which is capable of absorbing or dispersing instead of liberating heat during reaction to decrease the reaction rate of the starting materials. The semi-product obtained thereby has a large amount of a low-Ni content compound which is anticipated to assure the toughness, softness, and ductility for the semi-product. Therefore, it is capable of suffering deformation caused by any of cold or hot works such as a rolling, forging, calcining, extruding, drawing, or pressing process to reduce or eliminate a large number of pores remaining in the semi-product. The semi-product is further subjected to a second stage process of a normal sintering. The low-Ni content compounds react with the unreacted pure Ni powders in the semi-product to give a product having a phase of $Ni_3Al$ during the normal sintering process. The product is subject to a pore-eliminating process and an annealing process to be further densified. The aforementioned processes to achieve for the product the above-mentioned characteristics therewith construct and promote the multi-stage sintering powder metallurgy (MSPM) process of this invention.

Figure 1:
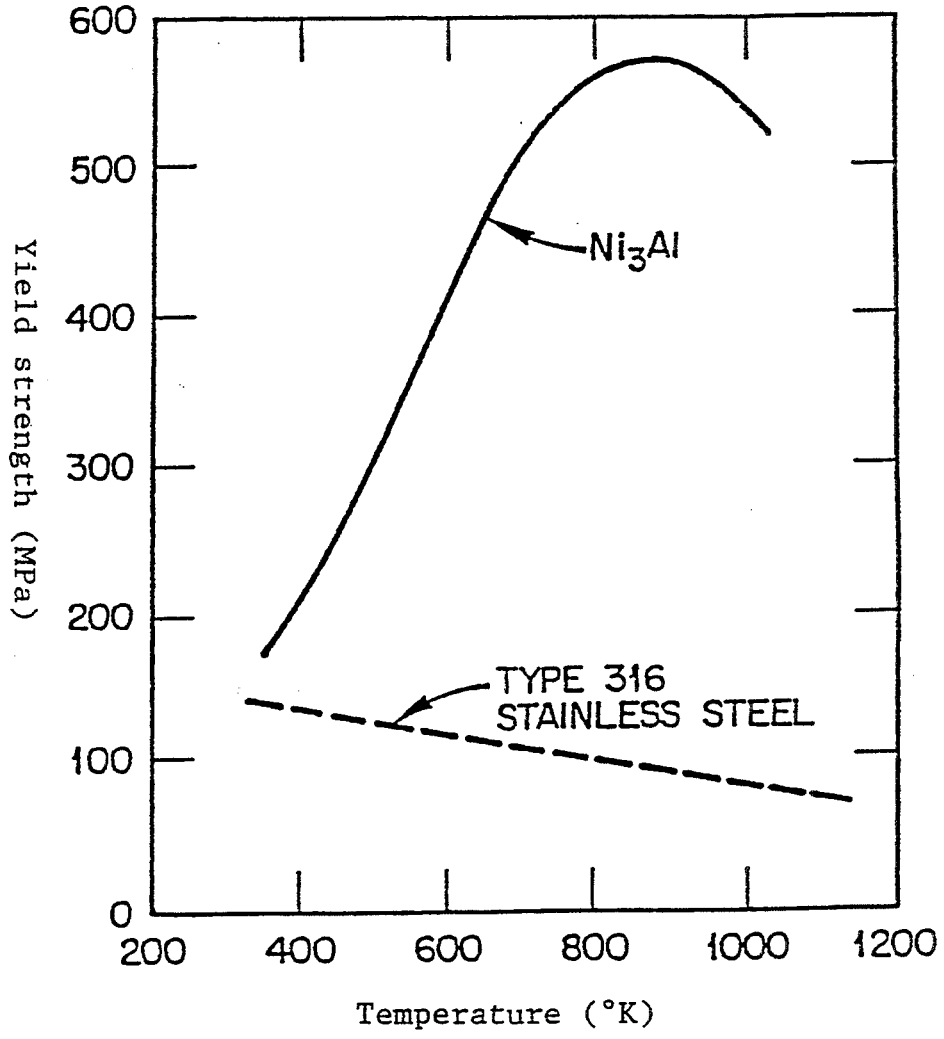
FIG. 1 shows characteristic curves of strength vs. temperature of a prior $Ni_3Al$ intermetallic compound and a prior Type 316 stainless steel.

It is shown in FIG. 1 that the strength of a $Ni_3Al$ intermetallic compound increases with the elevation of the environmental temperature, which differs remarkably from any of the prior results. It is due to the dislocation cross-slip pinning process in the micro-structure occurring at an elevated temperature. In FIG. 1, a strength curve versus temperature of Type 316 stainless steel is compared to that of one product according to the prior disclosures. In the applications of the aerospace industry, a high-temperature durable material such as a Ni-based alloy has a high strength due to the fact that it has a secondary phase of $Ni_3Al$ around 40% or less in volume. The $Ni_3Al$ compound can also be produced if adopting a process of mixing Ni and Al powders and then directly raising the temperature to above 1000° C. (or about 1200° C. in general) to reactively sinter the mixed powders, or adopting a process of sintering the mixed powder at a lower temperature of about 650° C. and homogenizing it at an elevated temperature of about 1000° C. However, the resultant pores in the product are still significant and cause the product to have a porosity of about 20% or more, i.e., the product density of $Ni_3Al$ is less than 80% referring to the theoretic density, so that the size or scale of the product is unable to be precisely controlled. To seek after for the reasons, it can be explained from the Table 1 which shows the published or calculated volume changes of various Ni and Al compounds during reaction.

TABLE 1

Volume change of various compounds of Ni and Al

| Number | Reaction | Volume change (%) |
|---|---|---|
| 1 | $3Al + 2Ni \rightarrow Al_3Ni_2$ | −4.2 |
| 2 | $Al_3Ni_2 + Ni \rightarrow 3NiAl$ | −9.72 |
| 3 | $NiAl + 2Ni \rightarrow Ni_3Al$ | −2.73 |

Figure 1A:
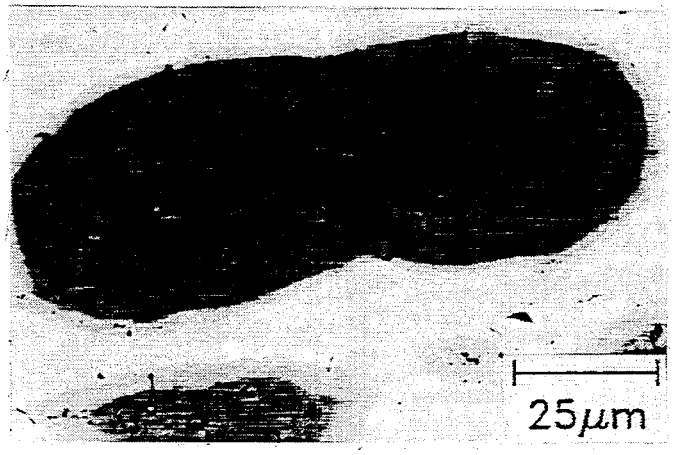
FIGS. 1*a*–1*c* are photographs depicting first semi-product resulting from formation of NiAl phase.
Figure 1B:
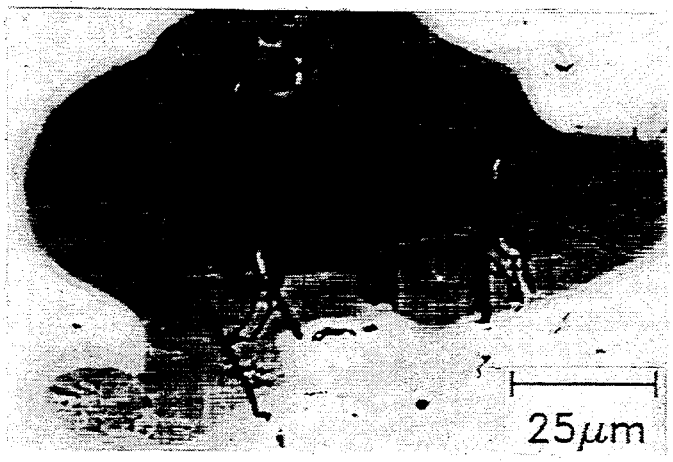
Figure 1C:
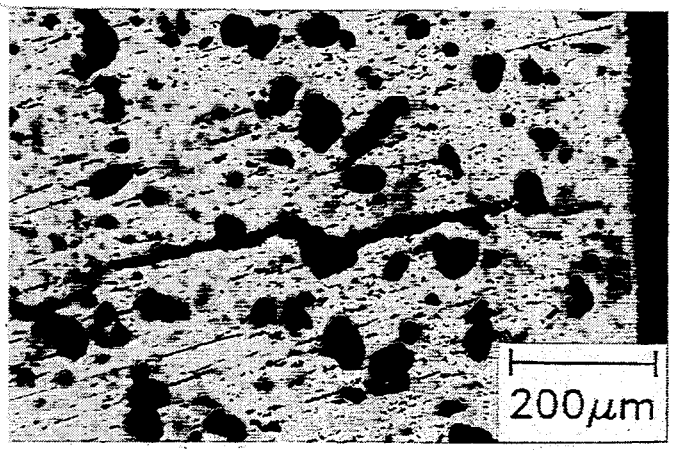
Figure 2E:
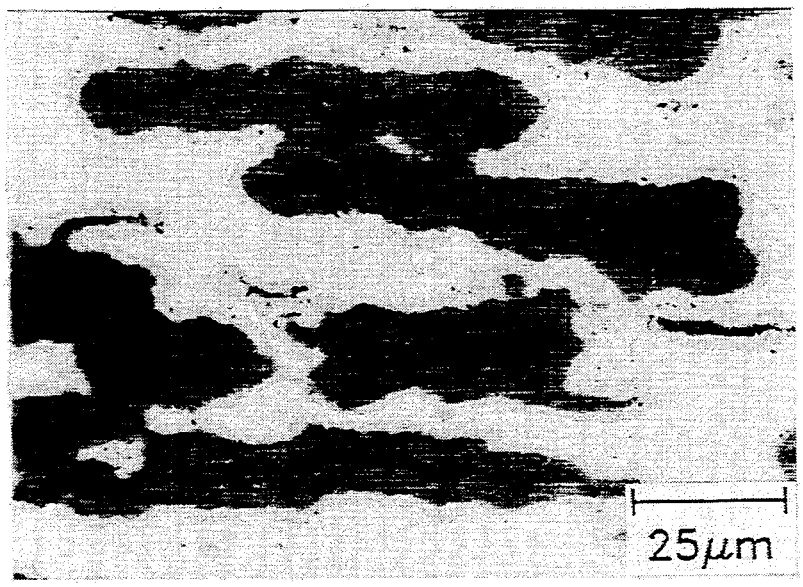
FIGS. 2*e*–2*f* are photographs depicting B-specimen after centering.
Figure 2F:
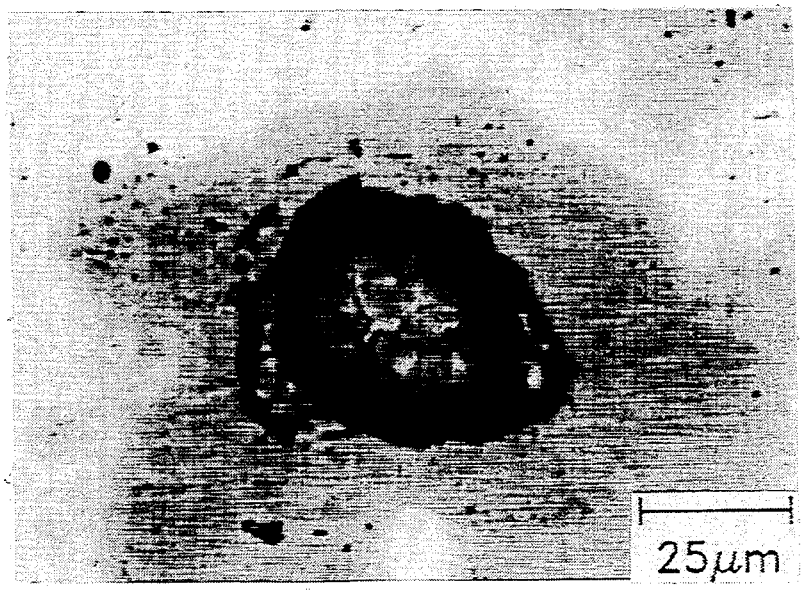

Practically, it has been observed in experiments that there were still 5%–15% of porosity more than those listed above. The melting point of Al is about 660° C. When Al reacts and incorporates with Ni, the heat evolving from reaction causes an elevation of the specimen temperature. If the reaction is proceeded at a temperature about 600° C., the evolved heat will raise the temperature to cause the Al particle to form a transient liquid phase, as shown in FIG. 2-(*a*) and 2-(*b*). The Al particle of the transient liquid phase will diffuse and penetrate into the space among adjacent Ni powder grains through a capillary force, as shown in FIG. 2-(*c*). A diffused Al grain reacts with its surrounding Ni atoms to form an $Al_3Ni_2$phase and leaves a pore of almost the same size as that of the Al grain at its original site, as shown in FIG. 2-(*d*). The pore has to be healed during the powder metallurgical process so that the obtained product has required density and mechanical strength. The Inventors tried to mix and compact Al powders together with Ni and Ni-B alloy powders to obtain a specimen, designated as A-specimen hereinafter. In the experiment, A-specimen was heated up and pre-sintered to a temperature about 650° C. and the temperature of A-specimen was recorded as a function of time, as shown in FIG. 3. It is shown from FIG. 3 that a reaction occurred when the temperature was raised only to about 600° C., and the temperature was dramatically raised by an increment of about 200° C. with the assistance of the exothennic heat from the reaction. An X-ray diffraction analysis of pre-sintered A-specimen, as shown in FIG. 4, shows that a large amount of NiAl and a small amount of $Ni_3Al$ phases, both of which are high-Ni content compound, were formed and an unreacted pure Ni phase was remained. Preliminarily sintered A-specimen was further subjected to a light cold rolling and had a reduction of about 7.5% in area, as shown in FIGS. 1*a*–1*c*. Although a large amount of unreacted pure Ni existed, due to the presence of a brittle NiAl phase in A-specimen, it could be found that many cracks and crazes were formed on A-specimen. From photographs taken at a rolling surface and a longitudinal cross-section, crazes developing along the direction perpendicular to the rolling direction could be seen and the crazes are concentrated at the NiAl phase and its surroundings. That is, cracks and crazes easily occur at the NiAl phase. Growth of the cracks in the specimen makes the specimen be formed into broken pieces. Basically, the pure two-stage sintering process cannot manufacture thereby an ideal Ni—Al intermetallic compound through the powder metallurgical processes depicted and discussed above.

Figure 5:
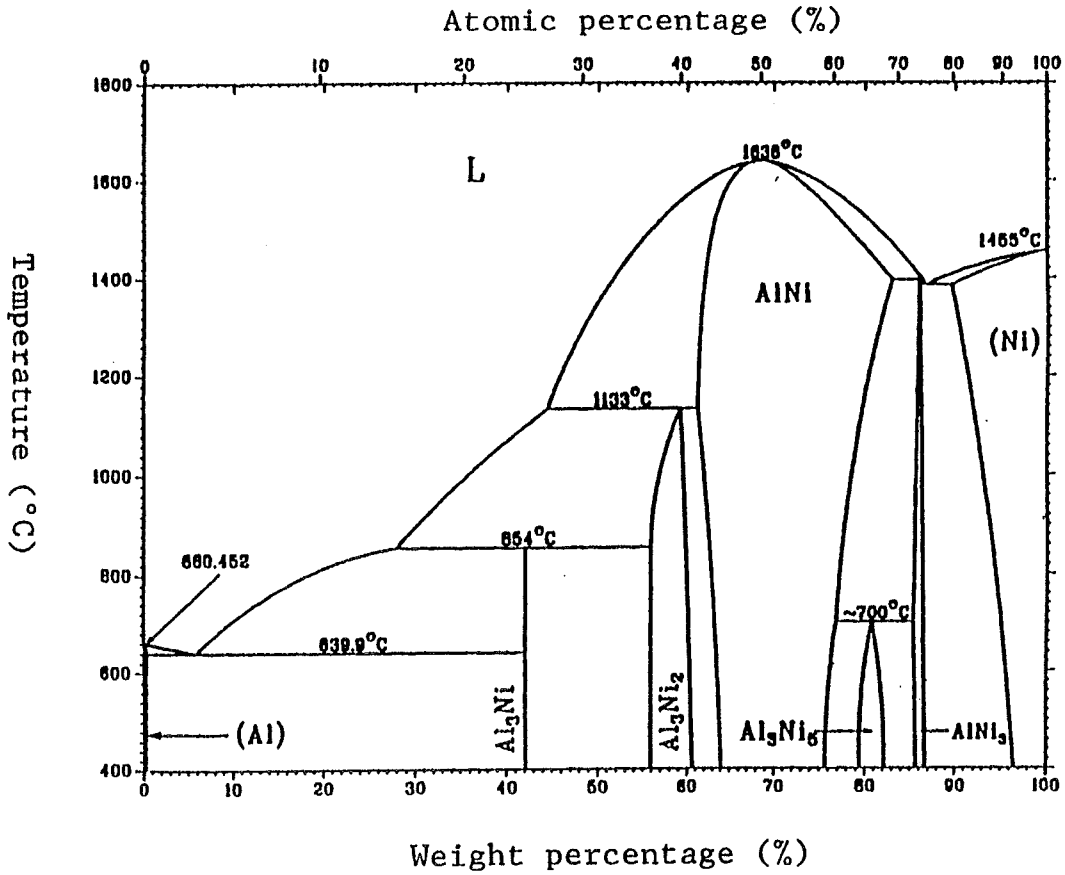
FIG. 5 is a Ni—Al binary phase diagram according to this invention.

We may look at the phase diagram of the Ni—Al binary system as shown in FIG. 5. A $Ni_2Al_3$ phase exists at the left side of the NiAl phase. The $Ni_2Al_3$ phase did not cause people's attention because of its low melting point of about only 1133° C. The Inventors tried another experiment to let Al, Ni, and $Ni_3B$ powders be mixed and compacted, and then the compact powders were canned into a 304 stainless steel washer. It is designated as B-specimen. The weight ratio of the compact powders and the stainless steel is about 1:1±10%. B-specimen was subjected to a preliminary sintering at a temperature of about 650° C. The variation of the temperature of the compact powders was recorded, as shown in FIG. 6. The compact powders did not react until the temperature reached about 620° C. Owing to the majority of the exothermic heat resulting from the reaction was absorbed and diluted by the 304 stainless steel shell, the specimen temperature raised only about 70° C. The X-ray diffraction analysis of B-specimen after the preliminary sintering process was shown in FIG. 7. It shows that a large amount of a low-Ni phase such as a $Ni_2Al_3$ phase and a residual unreacted pure Ni phase were formed. While investigating the SEM photograph of B-specimen after the preliminary sintering process, shown in FIGS. 2*c*–2*f*, the B-specimen containing a large amount of $Ni_2Al_3$ did not develop any severe crack thereon after suffering a 30% deformation from processing and its integrity was maintained. Pores formed thereon in the preliminary sintering process were collapsed and the powder particles adjacent to each pore were jointed to each other during the work. The collapsed pores were healed during a subsequent normal sintering process at an elevated temperature. Although some minor crazes were formed on the B-specimen, the propagation of the developing crazes was confined by the surrounding Ni phase.

Figure 8:
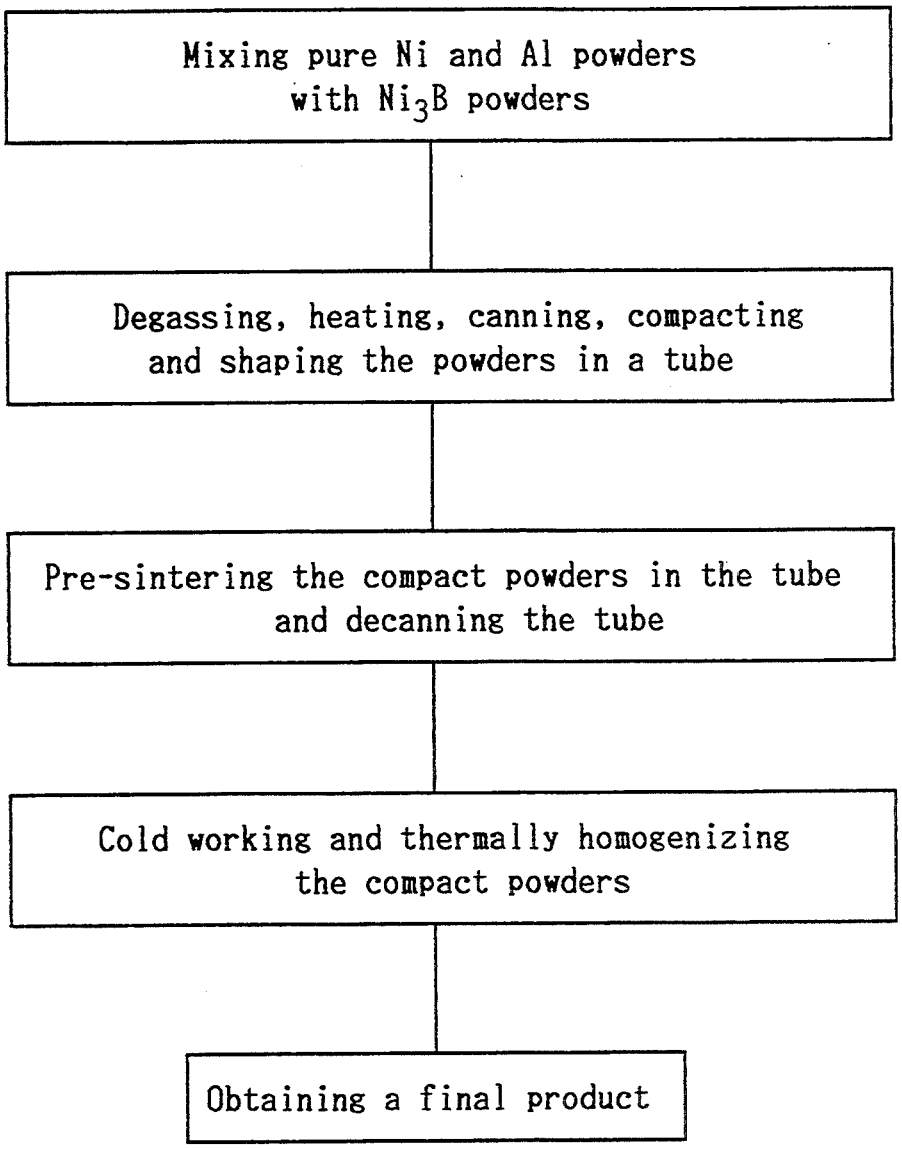
FIG. 8 is a flow chart of a process for a product obtained via mixing powdery starting materials according to this invention.
Figure 9:
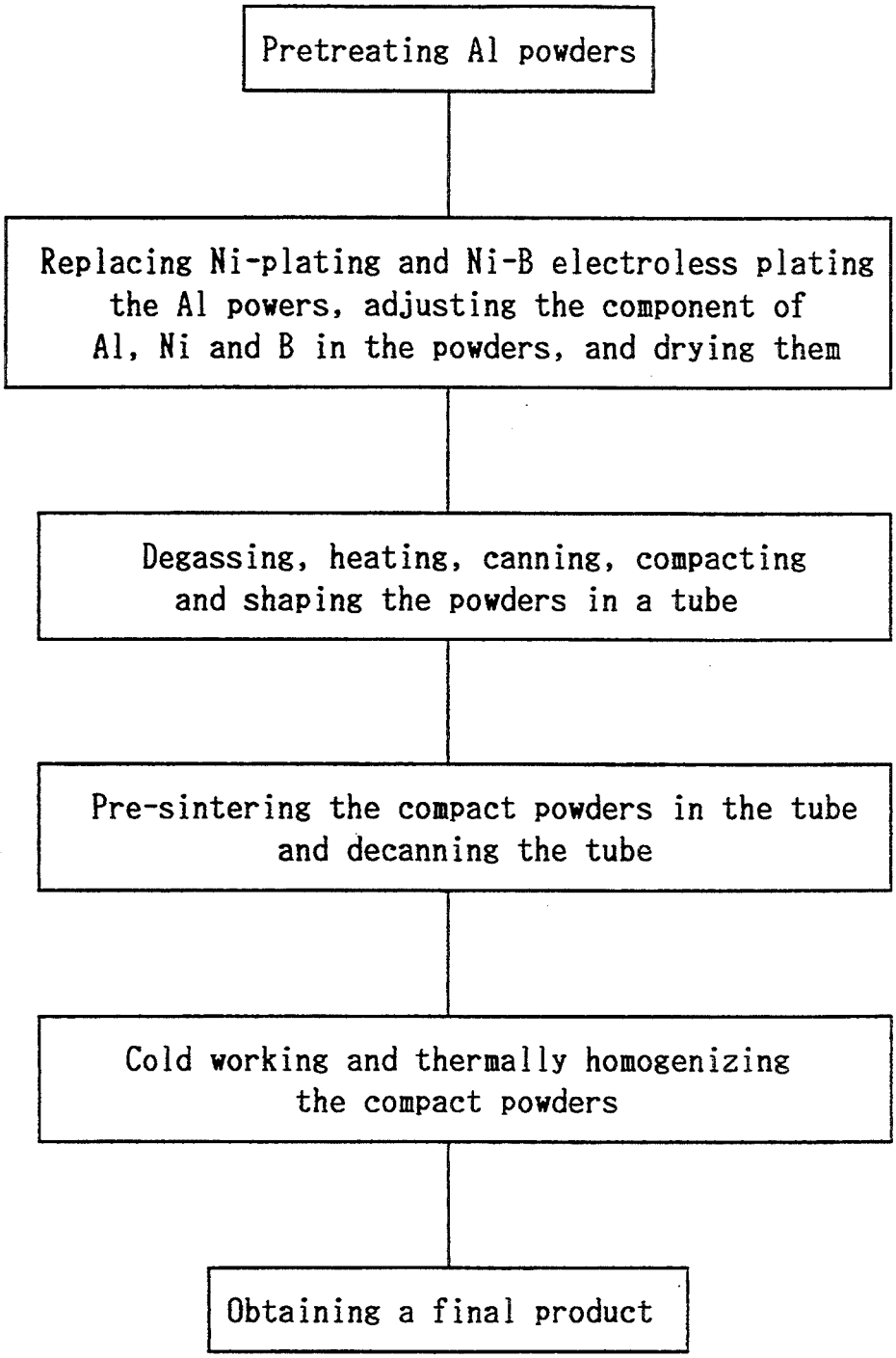
FIG. 9 is a flow chart of a process for a product obtained via a electroless plating treatment to powdery starting materials according to this invention.

The main feature and the technique of this invention are to adopt a multi-stage sintering process to manufacture a Ni—Al intermetallic compound having a high density and a high strength. In the multi-stage sintering process, a powdery starting material comprising Ni and Al powders is mixed and compacted into a compact powders and placed in contact with a heat absorbent which is inert to the compact powders. The heat absorbent is sufficient to absorb and dilute the exothermic heat resulting from the reaction of Ni with Al in the compact powders to prevent the temperature thereof from being excessively increased so that the desired pre-sintered semi-product having a low-Ni content compound such as a $Ni_2Al_3$ phase and a pure Ni phase is obtained during the preliminary sintering process. The pre-sintered semi-product has a reduced area and forms big pores therein due to the particles of the transient Al liquid phase penetrating and diffusing into the space among its adjacent particles. The desired pre-sintered semi-product has a tough low-Ni content compound phase to offer its required toughness to be free from cracking and a soft pure Ni phase to offer its ductility to be able to suffer any hot or cold work such as a rolling, forging, extruding, drawing, calendering, or pressing. Therefore, the pre-sintered semi-product will not crack or break during the pore-eliminating process and be capable of being shaped to obtain a desired or a similar shape of the final product. Further subjecting the semi-product to a normal sintering process will heal the collapsed pores and transform the low-Ni content compound reacting with the pure Ni powders into a sintered product having a desired phase such as a $Ni_3Al$ phase. If a temperature above 1133° C. is used for normal sintering, say 1200° C., the liquid phased from $Ni_2Al_3$ will be developed and be much beneficial to heal or to eliminate any pores, cracks, or crazes. If adding B or $Ni_3B$ powders into the starting material, the sintered product will have a $Ni_3Al+B$ phase. The sintered product can be subjected to one or more works or annealing treatments to thoroughly eliminate the minute pores caused by the volume constriction of the product to increase its density. Through the aforementioned processes, a product of a Ni—Al intermetallic compound having a large dimension and any desired geometric shape, such as a sheet, a plate, a rod, a fiber, a wire, or a tube, is obtained accordingly. FIG. 8 illustrates a process, according to the present invention, starting from mixing the weighted Al, Ni, and B or $Al_3B$ powders into a mixture, and FIG. 9 presents a process, according to the present invention, setting forth from Ni—B electroless plating one or both of the Al and Ni powders, drying them, vacuum degassing, e.g., dehydrogenating, from them by heating, and then mixing them into a mixture. The mixture obtained in either way depicted above, is shaped into a powder compact by a cold rolling process or by other cold work. The shaped compact attaching thereto a heat absorbent is subjected to a preliminary sintering process, and then the heat absorbent is removed from the compact before the subsequent pore-eliminating process being a hot or cold work, a normal sintering process, and one or more cycles of pore-eliminating and annealing processes.

The present invention will now be described more specifically with reference to the following examples. It is to be noted that the following descriptions of examples including preferred embodiments of this invention are presented herein for purpose of illustration and description only; it is not intended to be exhaustive or to be limited to the precise form disclosed.

EXAMPLE 1

(A) Preparation of an intermetallic mixture:

Take and mix 76.84 gm of Ni powders having a purity of above 99.9% and an average diameter of about 5 μm, 11.40 gm of Al powders having a purity of above 99.5% and an average diameter of about 22 μm, and 1.87 gm of $Ni_3B$ powders having a purity of above 99.5% and an average diameter of about 60 μm as a starting material. The starting material is placed into a cylindrical polyethylene mixer to proceed a mixing process at a speed of 90 rpm for about 2 hours. The thoroughly mixed powder specimen has a composition of Al being 24.0 at %, B being 0.12 wt %, and Ni being the remaining.

(B) Shaping:

The mixed powder specimen is thermally treated to desorb the gases from them in a vacuum environment and at about 400° C., then is canned and mechanically sealed into a 304 stainless steel tube in air. The tube and the specimen contained therein are cold rolled with a deformation of about 60% into a piece of a steel jacket having the specimen therein. The weight ratio of the specimen to the stainless steel is about 1:1.04.

(C) Preliminarily reactive sintering:

The obtained steel jacket with the specimen therein is put into a vacuum thermal furnace for a preliminary sintering process at about 650° C. for about 30 minutes. The elevation rate of the furnace temperature is about 10° C./min. During the process, the temperature variation of the specimen is measured by a inserted K-type thermocouple and a PC-controlled multi-meter (Model: HP-3457A of Hewlett Packard).

(D) Rolling and homogenization:

The pre-sintered specimen is stripped off the steel jacket and subjected to a first cold rolling with a deformation of about 30%, then is put into a vacuum thermal furnace for a normal sintering at a high temperature of about 1200° C. for about 2 hours for the purposes of healing pores and transforming the specimen to obtain a uniformly distributed $Ni_3Al$ product.

Figure 10:
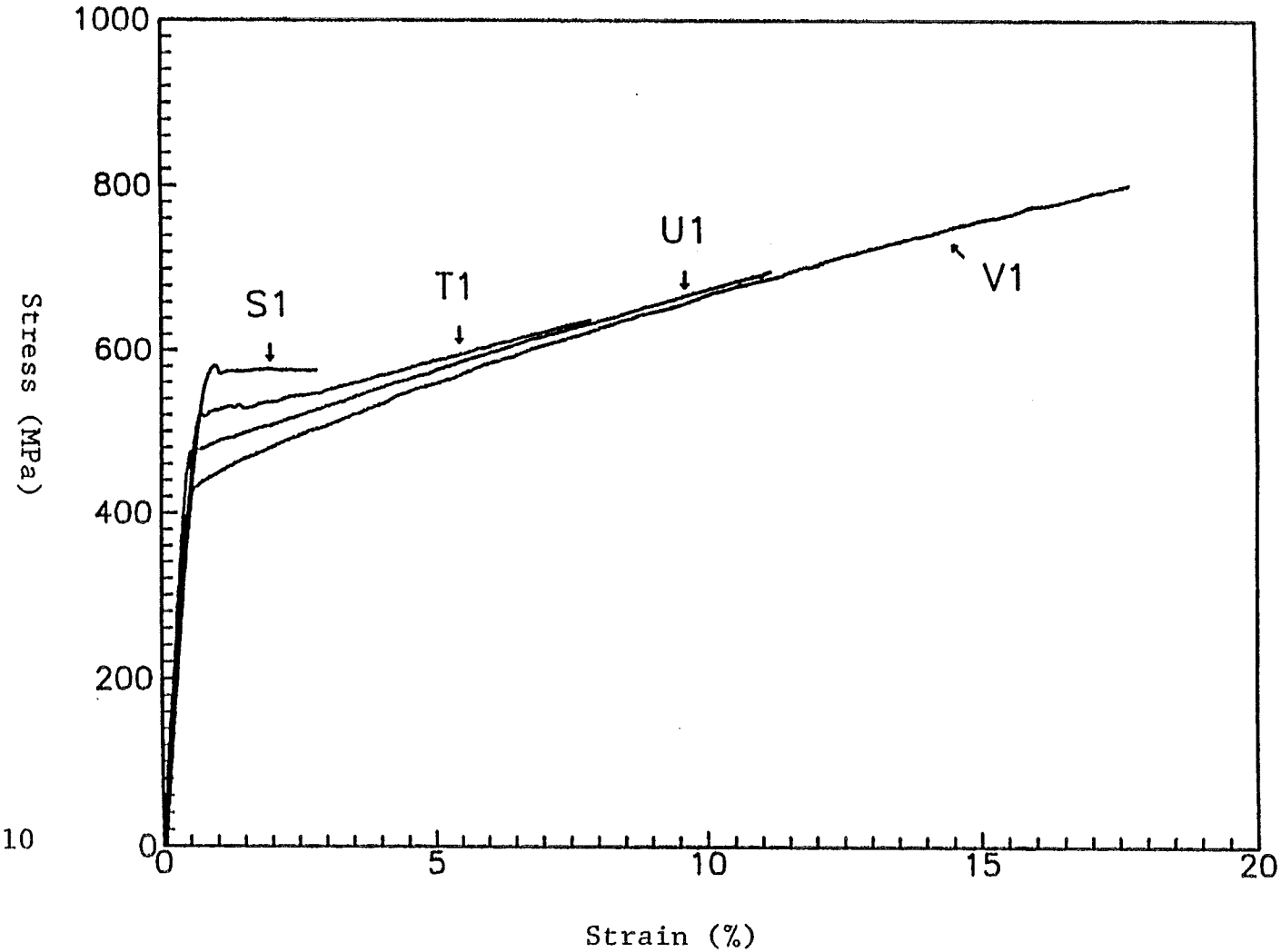
FIG. 10 is a stress-strain plot obtained by an MTS tensile tester for an ASTM standard specimen of Example 1 according to the present invention.

(E) Testing:

The mechanical properties of the produced ASTM standard specimen at each stage, as shown in FIG. 10, are obtained by an MTS test machine. The pre-sintered specimen, named as Specimen S1 hereinafter, has an ultimate tensile strength of about 567±8 MPa, an elongation of about 2.9±0.5%, a relative density of about 93.86±0.03% referring to the theoretic density. The specimen, after the normal sintering process, further suffering a second cold rolling with a reduction of about 15% in area and a first annealing process at about 1200° C. for 2 hours and being named as Specimen T1 hereinafter, has an ultimate tensile strength of about 654±14 MPa, an elongation of about 8.4±0.5%, and a relative density of about 96.29% referring to the theoretic density. The specimen being subjected to a third cold rolling with a reduction of about 10% in area and a second annealing at about 1200° C. for about 2 hours after experiencing the normal sintering, the second cold rolling, and the first annealing, named as Specimen U1 hereinafter, has an ultimate tensile strength of about 667±30 MPa, an elongation of about 9.3±1.9%, and a relative density of about 97.07±0.06% referring to the theoretic density. The specimen being subjected to five cycles of two additional cold rolling processes of about 8.5% and 7% reduction in area and two annealing processes at about 1200° C. for about 2 hours after experiencing the normal sintering, named as Specimen V1, has a relative density of about 98.60±0.03%. The final product of Specimen V1 is tested at both room temperature and 800° C. The obtained mechanical properties thereof such as the yield strength (YS), the ultimate tensile strength (UTS), the Young's modulus (E), and the maximum strain, are listed in Table 2.

TABLE 2

Mechanical properties of Specimen V1 at room temperature and 800° C.

| Temperature (°C.) | YS (MPa) | UTS (MPa) | E (Gpa) | Max. Strain (%) |
|---|---|---|---|---|
| 25° C. | 433 ± 5 | 773 ± 33 | 182 ± 4 | 16.1 ± 1.6 |
| 800° C. | 631 ± 21 | 631 ± 21 | 161 ± 3 | 0.37 ± 0.02 |

EXAMPLE 2

Prepare a replacing Ni-plating solution and a electroless plating solution respectively as listed in Table 3.

TABLE 3

Compositions and related values of prepared Ni-plating solution

| Replacing Ni-plating solution | Value | Electroless Plating solution | Value |
|---|---|---|---|
| Nickel chloride (gm/l) | 30 | Nickel chloride (gm/l) | 30 |
| Sodium citrate (gm/l) | 20 | Dimethylaminoborane (gm/l) | 3.5 |
| Ammonium chloride (gm/l) | 7 | Malonic acid (gm/l) | 40 |
| Sodium fluoride (gm/l) | 0.5 | Thiourea (ppm) | 1–4 |
| pH value | 8–9 | pH value | 6–7 |
| Reaction temperature (°C.) | 25 | Reaction temperature (°C.) | 70 |

Immerse 14.5 gm of Al powders having a size of about 20 μm into the replacing Ni-plating solution at room temperature for about 2 hours. The Al powders are taken out from the replacing Ni-plating solution and water-washed to the neutral state. The pretreated Al powders are subjected to a electroless plating process in the electroless plating solution with the assistance of a magnetic agitator to mix the Al powders and the solution sufficiently. After 20 minutes, add Ni powders of 78.00 gm into the solution to adjust the Ni and B contents in the Ni—Al intermetallic powders to be finally produced. After the reaction terminates, the obtained powders are water-washed and dried. Through a consecutive processes, such as canning, sealing, shaping, preliminary sintering, rolling, normal sintering, etc., similar to steps (B) to (D) described in Example 1, the obtained high-density composite product has a composition of Al being 23.89 at %, B being 0.1 wt %, and Ni with other elements being the remaining, as listed in Table 4.

TABLE 4

Composition analysis of the product in Example 2 through ICP-AES.

| Ni (at %) | Al (at %) | B (wt %) | S (ppm) | Fe (ppm) | Cu (ppm) |
|---|---|---|---|---|---|
| bal. | 23.89 | 0.13 | <10 | 56 | <3 |

The specimen obtained after the normal sintering process, named as Specimen S2, has an ultimate tensile strength of about 724±35 MPa, an elongation of about 8.5±0.5%, and a relative density of about 97.8% referring to the theoretic density. The specimen being further subjected to a first cold rolling with a reduction of about 15% in area and a first annealing at about 1200° C. for about 2 hours after the normal sintering, named as Specimen T2, has an ultimate tensile strength of about 769±30 MPa, an elongation of about 14.8±1.95%, and a relative density of about 98.8% referring to the theoretic density.

EXAMPLE 3

Follow a similar procedure as described in Example 1, while pure B powders are added during the intermetallic powder preparation step instead. The amounts of the starting materials are: 78.60 gm of Ni powders, 11.40 gm of Al powders, and 0.108 gm of B powders having a purity of above 99.5% and an average diameter less than 60 μm.

EXAMPLE 4

Follow a similar procedure described in Example 1, while the amount of Ni powders is 72.85 gm and that of Al powders is 15.39 gm during the preparation process. The final product of Ni—Al intermetallic compound has an Al composition of about 31.0 at % and has a high-density $Ni_3Al$ and NiAl dual phase.

EXAMPLE 5

Follow a similar procedure described in Example 1, while the amount of Ni is 69.14 gm and that of Al is 29.10 gm. The final product of Ni—Al intermetallic compound has an Al composition of about 37.0 at % and has a high-density $Ni_3Al$ and NiAl dual phase. The NiAl content of the final product is higher than that in Example 4.

The specimen in Example 5 obtained after the normal sintering process, named as Specimen S5, has an ultimate tensile strength of about 431±32 MPa, an elongation of about 1.63±002%, and a density of about 6.52±0.01 g/cm$^3$. The specimen, being further subjected to a first cold rolling process with a reduction of about 10% in area and an annealing process at about 1200° C. for about 2 hours after the normal sintering process, has an ultimate tensile strength of about 422±21 MPa, an elongation of about 1.38±0.12%, and a density of about 6.65±0.02 g/cm$^3$. These mechanical properties of specimens having $Ni_3Al$ and NiAl dual phases have not been found in any disclosure.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A process for manufacturing a densified powder metallurgic product comprising steps of:

(a) preparing a powdery starting material;

(b) pre-sintering said powdery starting material at a temperature below a melting point of said powdery starting material to obtain a semi-product;

(c) executing a pore-eliminating process for eliminating pores resulting from said step (b) on said semi-product to obtain a pore-eliminated semi-product; and (d) sintering said pore eliminated semi-product at a temperature higher than a melting point of said semi-product.

2. A process as claimed in claim 1, further comprising after said step (d) a step (d$^1$) of executing a pore-eliminating process.

3. A process as claimed in claim 2, further comprising after said step (d') a step (d'') of executing an annealing process.

4. A process as claimed in claim 1, wherein said powdery starting material comprises one selected from a group consisting of Ni and Al, Fe and Al, Ti and Al, and Ni and Ti elemental powders, and said semi-product is correspondingly one selected from a group consisting of nickel aluminides, iron aluminides, titanium aluminides and nickel titanides.

5. A process as claimed in claim 4, wherein said nickel-aluminide semi-product includes a relative small amount of high-Ni content compound and a relative large amount of a low-Ni content compound.

6. A process as claimed in claim 5, wherein said high-Ni content compound is $Ni_3Al$.

7. A process as claimed in claim 5, wherein said low-Ni content compound is $Ni_2Al_3$ and $NiAl_3$.

8. A process as claimed in claim 7, wherein said low-Ni content compound is preferably $Ni_2Al_3$.

9. A process as claimed in claim 5, wherein said step (d) results in a reaction of said low-Ni content compound with said Ni powders.

10. A process as claimed in claim 1, wherein said pore-eliminating process is capable of condensing said semi-product to have a reduced cross-section.

11. A process as claimed in claim 1, wherein said pore-eliminating process is executed by a procedure selected from a group consisting of cold work and hot work.

12. A process as claimed in claim 1, wherein said pore-eliminating process is at least one selected from a group consisting of rolling, calendering, drawing, extruding, forging, and pressing.

13. A process as claimed in claim 4, wherein a maximum temperature of Ni and Al is controlled under 800° C. in said pre-sintering step (b).

14. A process as claimed in claim 13, wherein said maximum temperature of said Ni and Al is preferably controlled under 700° C.

15. A process as claimed in claim 1, further comprising after said step (a) a step of mixing and then compressing said powdery starting material.

16. A process as claimed in claim 1, further comprising between said steps (a) and (b) a step of introducing a heat absorbent to be in contact with said powdery starting material.

17. A process as claimed in claim 16, wherein said heat absorbent is a material being inert to said powdery starting material.

18. A process as claimed in claim 16, wherein said heat absorbent is in contact with said powdery starting material in a way selected from a group consisting of ways of encompassing an outer surface of said powdery starting material and being embedded to an interior of said powdery starting material.

19. A process as claimed in claim 18, wherein said interior of said powdery starting material is a tubular hollow.

20. A process as claimed in claim 16, wherein said heat absorbent is formed as one selected from a group consisting of a tube, a sealing bag, a washer, a liner, a mold, and a combination thereof.

21. A process as claimed in claim 16, wherein said heat absorbent is made of one selected from a group consisting of a ferrous alloy, a stainless steel, Cu, Cu-based alloys, Ni, Ni-based alloys, and a mixture thereof.

22. A process as claimed in claim 16, wherein said heat absorbent further contains a cooling system therewith.

23. A process as claimed in claim 22, wherein said cooling system comprises a pipe and a coolant flowing therethrough.

24. A process as claimed in claim 4, wherein said temperature in said step (b) for presintering said Ni and Al is ranged from 500° C. to 800° C.

25. A process as claimed in claim 24, wherein said temperature in said step (b) for pre-sintering said Ni and Al is preferably ranged within 650°+50° C.

26. A process as claimed in claim 4 wherein said temperature in said step (d) for sintering said pore-eliminated nickel aluminide semi-product is ranged from 1000° C. to 1465° C.

27. A process as claimed in claim 26, wherein said temperature in said step (d) for sintering said pore-eliminated nickel-aluminide semi-product is preferably ranged within 1133° C. to 1250° C.

28. A process as claimed in claim 1, wherein said powdery staffing material is further introduced therein with additional elemental powders.

29. A process as claimed in claim 28, wherein said additional elemental powders are selected from a group consisting of pure B powders and Ni—B alloy powders.

30. A process as claimed in claim 28, wherein said additional elemental powders are, via a process selected from a group consisting of mixing and electroless plating processes, introduced into said powdery starting material.

31. A process as claimed in claim 28, wherein said pre-sintering process gives an intermediate product of $NiAl_3$+B.

32. A process as claimed in claim 28, a residual unreacted Ni phase is formed after said pre-sintering process.

33. A process as claimed in claim 28, wherein said sintering process gives a final product having a dual phase.

34. A process as claimed in claim 28, wherein said sintering process gives a final product selected from a group consisting of $Ni_3Al$+0.1% B and a two-phase mixture of $Ni_3Al$+0.1% B and NiAl+0.1% B.

35. A process for densifying a powder metallurgic product comprising the steps of:

(a) preparing a powdery starting material wherein said powdery starting material is selected from the group consisting of Ni and Al, Fe and Al, Ti and Al, and Ni and Ti elemental powders;

(b) pre-sintering said powdery starting material at a first temperature to obtain a semi-product, said semi-product is correspondingly one selected from a group consisting of nickel aluminides, iron aluminides, titanium aluminides and nickel titanides;

(c) executing a pore-eliminating process for eliminating pores resulting from said step (b) on said semi-product to obtain a pore-eliminated semi-product; and (d) sintering said pore eliminated semi-product at a second temperature, said second temperature being higher than said first temperature.

36. A process as claimed in claim 35, wherein said nickel-aluminide semi-product includes a relative small amount of high-Ni content compound and a relative large amount of a low-Ni content compound.

37. A process as claimed in claim 36, wherein said high-Ni content compound is $Ni_3Al$.

38. A process as claimed in claim 35, wherein a maximum temperature of said Ni and Al is controlled under 800° C. in said pre-sintering step (b).

39. A process as claimed in claim 38, wherein said maximum temperature of said Ni and Al is preferably controlled under 700° C.

40. A process as claimed in claim 35, wherein said temperature in said step (d) for sintering said pore-eliminated nickel aluminide semi-product is ranged from 1000° C. to 1465° C.

41. A process as claimed in claim 40, wherein said temperature in said step (d) for sintering said pore-eliminated nickel-aluminide semi-product is preferably ranged within 1133° C. to 1250° C.

42. A process for sintering a powder metallurgy product comprising aluminum and at least one metal selected from the group consisting of nickel, iron and titanium comprising the step of presintering powdery starting material in thermal contact with a heat absorbent for maintaining the sintering temperature below a melting point of the starting material.

* * * * *

UNITED STATES PATENT AND TRADEMARK OFFICE

CERTIFICATE OF CORRECTION

PATENT NO. : 5,445,790

DATED : August 29, 1995

INVENTOR(S) : Chen-Ti Hu; Wen-Chih Chiou

It is certified that error appears in the above-indentified patent and that said Letters Patent is hereby corrected as shown below:

Column 2, line 3, change "foundedly supported" -- foundationally supported --.
Column 2, lines 13, 14, change "have already been resulted before the pore having been able to be healed" to -- have resulted before the pore could be healed --.
Column 3, line 13, change "preferably" to -- preferable --.
Column 4, line 15, change "DRAWING" to -- DRAWINGS --.
Column 4, line 45, change "a electroless" to -- an electroless --.
Column 5, line 4, change "there would be problematic to proceed the" to -- it would be problematic to proceed with --.
Column 5, line 28, before "liquid" delete "a".
Column 5, line 41, change "from dramatically" to -- from a dramatic --.
Column 6, line 27, change "To seek after for" to -- To set forth --.
Column 6, line 47, change "FIG. 2-(a) and 2-(b)" to -- FIGS. 2-(a) and 2-(b) --.
Column 6, line 52, change "$Al_3Ni_2$phase" to -- $Al_3Ni_2$ phase --.
Column 6, line 67, change "exothennic" to -- exothermic --.
Column 7, line 4, after "phase" delete "was".
Column 7, line 17, after "specimen" insert -- to --.
Column 7, line 25, change "cause" to -- attract --.
Column 7, line 29, change "canned into" to -- canned in --.

UNITED STATES PATENT AND TRADEMARK OFFICE

CERTIFICATE OF CORRECTION

PATENT NO. : 5,445,790

DATED : August 29, 1995

INVENTOR(S) : Chen-Ti Hu; Wen-Chih Chiou

It is certified that error appears in the above-indentified patent and that said Letters Patent is hereby corrected as shown below:

Column 7, line 38, after "reaction" insert -- that --.
Column 7, line 39, after "temperature" insert -- was --.
Column 7, line 46, change "FIGS. 2c-2f" to
-- FIGS. 2e-2f --.
Column 7, line 52, change "jointed" to -- joined --.
Column 7, line 63, before "compact" delete "a".
Column 8, line 24, before "beneficial" delete -- much --.
Column 10, line 41, after "Through" delete "a".
Column 13, line 23, change "staffing" to -- starting --.

Signed and Sealed this

Second Day of July, 1996

Bruce Lehman

*Attest:*

BRUCE LEHMAN

*Attesting Officer*

*Commissioner of Patents and Trademarks*